United States Patent [19]

Seager

[11] Patent Number: 5,025,960

[45] Date of Patent: Jun. 25, 1991

[54] DISPENSER WITH HOLLOW DRIVE ROD

[75] Inventor: Richard Seager, Mystic, Conn.

[73] Assignee: Risdon Corporation, Naugatuck, Conn.

[21] Appl. No.: 446,137

[22] Filed: Dec. 5, 1989

[51] Int. Cl.[5] ..... B67D 5/42

[52] U.S. Cl. ..... 222/390; 222/153

[58] Field of Search ..... 222/153, 390, 464, 482, 222/546, 386, 384, 402; 401/172-175; 602/224

[56] References Cited

U.S. PATENT DOCUMENTS

| | | | |
|---|---|---|---|
| 1,244,894 | 10/1917 | Renouf | 401/101 |
| 1,309,900 | 7/1919 | MacCorkell | 401/175 |
| 1,936,822 | 11/1933 | Boenecke | 221/79 |
| 1,965,690 | 7/1934 | Creveling | 222/390 X |
| 1,971,127 | 8/1934 | Arnold et al. | 222/390 |
| 2,029,055 | 1/1936 | Burke | 222/390 X |
| 2,112,450 | 3/1938 | Tear | 222/390 X |
| 2,123,741 | 7/1938 | Newton | 222/390 X |
| 2,163,974 | 6/1939 | Blett | 221/79 |
| 2,487,642 | 11/1949 | DeWaltoff | 222/390 X |
| 2,540,511 | 2/1951 | Coleman | 222/320 |
| 2,799,881 | 7/1957 | Howe | 15/137 |
| 2,991,915 | 7/1961 | Boehm | 222/320 |
| 2,998,167 | 8/1961 | Boehm | 222/320 |
| 3,078,011 | 2/1963 | Safianoff | 222/390 X |
| 3,175,740 | 3/1965 | Duda | 222/390 |
| 3,420,417 | 1/1969 | Kardel | 222/390 |
| 4,071,300 | 1/1978 | Nichols et al. | 401/175 |
| 4,139,127 | 2/1979 | Gentile | 222/390 |
| 4,598,843 | 7/1986 | Foster et al. | 222/153 |
| 4,863,072 | 9/1989 | Perler | 222/390 |

*Primary Examiner*—Kevin P. Shaver

*Attorney, Agent, or Firm*—St. Onge, Steward Johnston & Reens

[57] ABSTRACT

The present invention relates to a dispenser for flowable material having a container with open and closed ends and a dispensing head with a product outlet mounted on the open end of the container. The flowable material, stored within the chamber defined by the container, is forced by a piston downwardly through the chamber and then upwardly through a hollow rod on which the piston is mounted, a tube extending from the dispensing head, and the product outlet. The threaded rod terminates at a cup which receives and is sealed by sealing surfaces of the tube, thereby providing a fluid coupling from the container to the dispensing head.

12 Claims, 3 Drawing Sheets

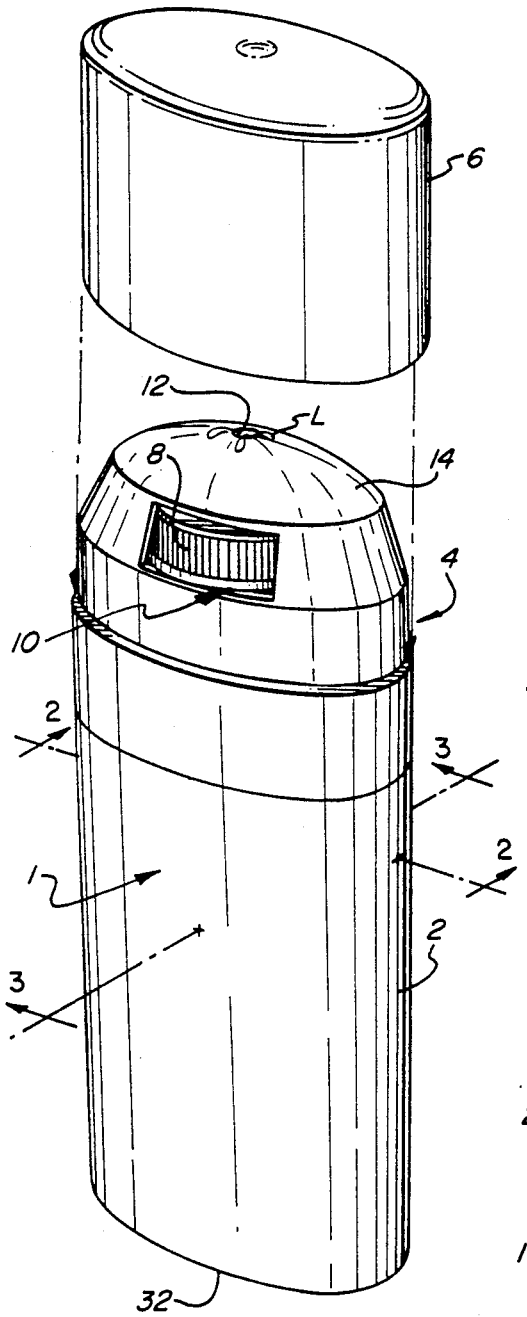
FIG. 1
FIG. 2
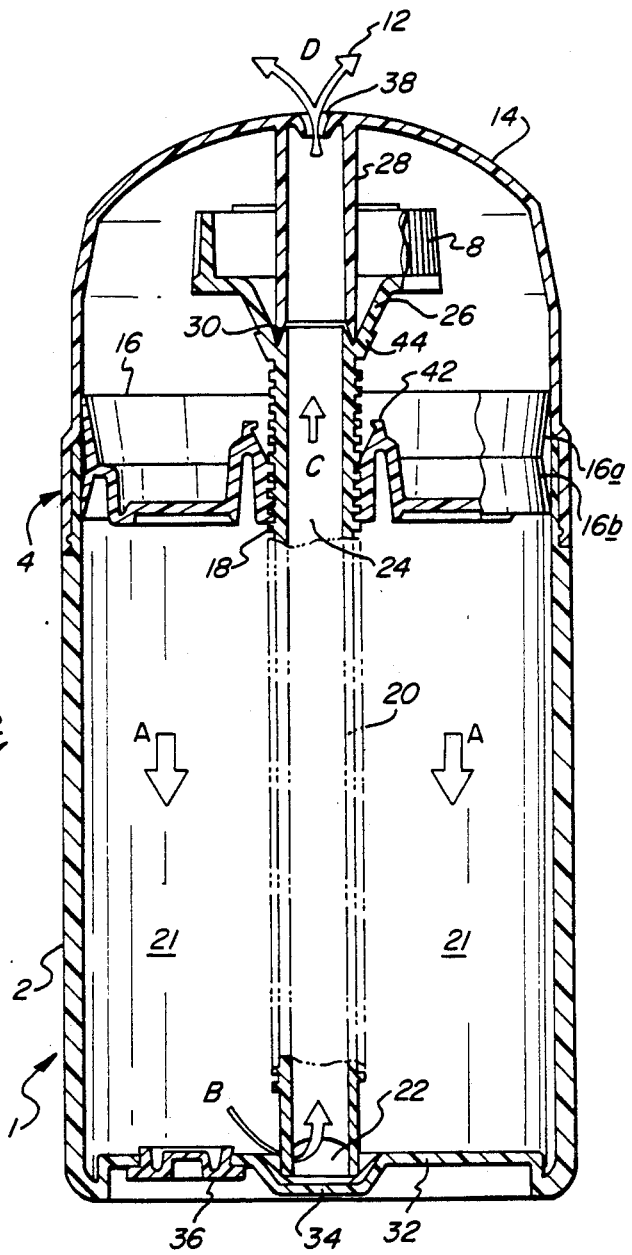

DISPENSER WITH HOLLOW DRIVE ROD

BACKGROUND OF THE INVENTION

Dispensers for flowable materials are available in a variety of forms, but, generally, all have a chamber for storing material to be dispensed and a product outlet through which such dispensing occurs. In one common type of dispenser, material within the chamber is pushed through the product outlet by a piston mounted on a rod within the container. In such dispensers, material is generally discharged from the container by advancing the piston along the rod toward the product outlet. However, material is dispensed from some devices by moving the piston away from the outlet. In such dispensers, the rod is hollow and has an opening at the end of the container distal from the product outlet. Movement of the piston toward this opening advances material into and through the rod toward the product outlet.

U.S. Pat. No. 1,936,822 to Boenecke, U.S. Pat. No. 2,163,974 to Blett, U.S. Pat. No. 2,540,511 to Coleman, U.S. Pat. No. 3,175,740 to Duda, and U.S. Pat. No. 3,420,417 to Kardel all disclose dispensers where an exterior actuator is rotated to move a piston downwardly on a hollow, threaded rod toward an opening at the bottom of the rod. The downward movement of the piston urges material within the dispenser to move into and upwardly through the hollow threaded shaft for discharge through an opening.

U.S. Pat. No. 2,799,881 to Howe and U.S. Pat. No. 4,071,300 to Nichols et al. disclose dispensing devices similar to those discussed in the preceding paragraph with material being discharged from the dispenser through brushes.

U.S. Pat. No. 2,998,167 and U.S. Pat. No. 2,991,915, both to Boehm, relate to reciprocating plunger-type dispensers where material is discharged by pressing a finger piece downwardly. The downward axial movement of the finger piece is converted to rotational motion, causing tube 14 to turn. Rotation of tube 14 moves a piston downwardly and urges material into and upwardly through the tube for dispensing through a spout.

U.S. Pat. No. 1,244,894 to Renouf and U.S. Pat. No. 1,309,900 to MacCorkell relate to shaving brushes in which shaving cream from within a dispenser body is urged through a tube onto the brush by advancement of a piston toward the brush.

All of these references have a product outlet attached to and movable with the rod for mounting the piston. As a result, none can employ a relatively wide, stationary dispensing device suitable for use in applying deodorants and lotions. The present invention overcomes this deficiency.

SUMMARY OF THE INVENTION

The present invention relates to a dispenser for flowable material, having a container for storage of material to be dispensed and a product outlet for discharge of this material. In operation, a piston, mounted on a hollow rod, pushes material downwardly through the container. Near the bottom of the container, material to be dispensed passes through an opening into the hollow rod. The hollow rod extends upwardly toward the product outlet so that downward movement of the piston causes material to pass upwardly through the hollow rod and through the product outlet. Since the material to be dispensed should be spread over a relatively wide area, the product outlet is positioned on a rounded dispensing head. The dispensing head and container are separate pieces with the dispensing head mounted on the open end of the container. Due to the separable nature of the dispensing head and the container, it is necessary to couple the hollow rod's interior to the dispensing head's product outlet. Such a coupling must connect the rotating rod with the product outlet so that material in the rod passes to the outlet without leaking into the dispenser interior.

The present invention achieves this objective by coaxially mounting a cup on the end of the hollow rod adjacent the open end of the container so the material passing upwardly through the rod enters the base of the cup. Extending into the opposite end of the cup is a tube leading to the dispensing head's product outlet. The portion of the tube within the cup has sealing surfaces which cause all material in the cup to ultimately enter the tube rather than leaking into the dispenser interior. These surfaces seal the cup even when it is rotated relative to the tube which is stationary—a significant achievement, because such relative rotation occurs whenever it is necessary to dispense material.

BRIEF DESCRIPTION OF THE DRAWINGS

FIG. 1 is a perspective view of a dispenser in accordance with the present invention with its cover lifted off.

FIG. 2 is a side cross-sectional view of the dispenser of the present invention taken along line 2—2 of FIG. 1 without a cover and with the piston in an advanced position.

DETAILED DESCRIPTION OF THE DRAWINGS

Figure 3:
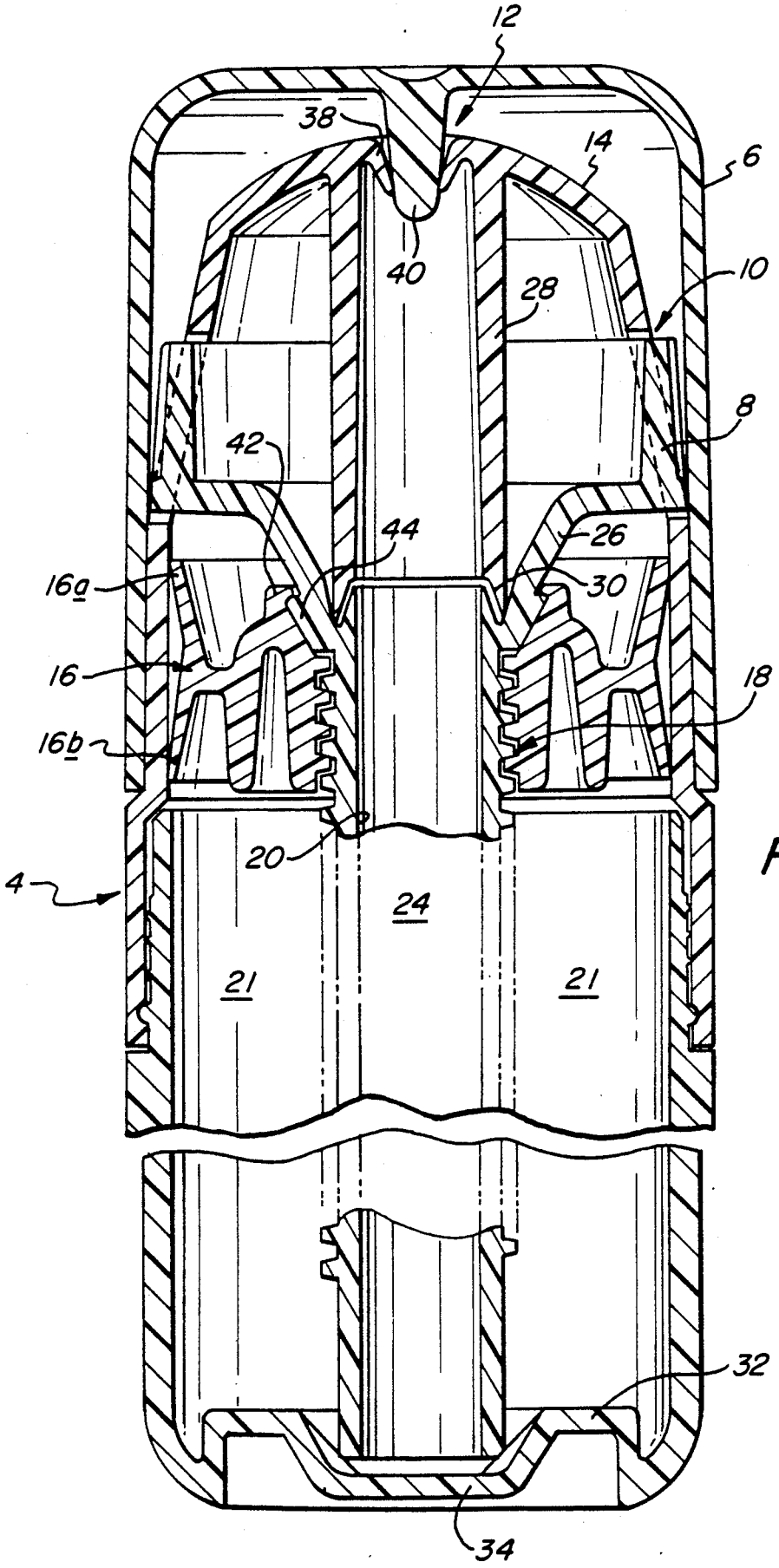
FIG. 3 is a side cross-sectional view of the dispenser of the present invention taken along line 3—3 of FIG. 1 with a cover over the dispensing head and with the piston in a retracted position.

FIG. 1 is a perspective view of a dispenser according to the present invention with its cover lifted off. The dispenser includes a container or base 1 with side walls 2 and a bottom 32. Mounted on base 1 is dispensing head 4 over which cover 6 can be fitted. Dispensing head 4 is provided with opposed openings 10 (only one of which is shown in FIG. 1 but see FIG. 3) through which drive wheel 8 can be accessed for rotation. When cover 6 is placed over dispensing head 4, it conceals opening 10 and knurled drive wheel 8. Dispensing head 4 includes product application surface 14 having product outlet 12. During dispensing, liquid L, stored within base 1, is discharged through product outlet 12 and spreads over product application surface 14. Such spreading of product to be dispensed permits application of material to a fairly large surface. Such dispensers are particularly useful for application of deodorants, lotions, etc.

FIG. 2 is a side cross-sectional view of the dispenser of the present invention taken along line 2—2 of FIG. 1 without a cover and with piston 16 in an advanced position. Material to be dispensed is stored within chamber 21, defined by side walls 2 and bottom 32 of base 1. Also located within chamber 21 is piston 16 having threaded opening 18 by which it is mounted to threaded rod 20. Piston 16 sealingly engages the interior of side walls 2 with upper and lower wiping surfaces **16*a* and 16*b*, respectively. The bottom of threaded rod 20 has an axial opening which is received within connection indentation 34 to position the rod within base 1. Also located at the bottom of threaded rod 20 is radial rod opening 22 which leads to internal rod passage 24. Internal rod passage 24 extends longitudinally through threaded rod 20 and terminates at rod cup 26. Rod cup 26 is coaxially joined in end-to-end fashion to threaded rod 20. Knurled drive wheel 8 is also integral with rod cup 26—the former being positioned above and circumferentially around the latter. Knurled drive wheel 8 has a diameter greater than that of rod cup 26 which is in turn greater than the diameter of rod 20**.

Extending into rod cup 26 from above is discharge tube 28, having a hollow passage leading to product outlet 12 of dispensing head 4. To insure that material to be dispensed passes from rod cup 26 into discharge tube 28, the end of discharge tube 28 which terminates within the cup has cup engagement surface 30 to seal the cup. As a result, material passing upwardly through internal rod passage 24 ultimately enters and passes through discharge tube 28, flap 38, and product outlet 12.

Optionally, when base 1 is to be bottom-filled it can be provided with an opening in bottom 32 which is sealed by bottom plug 36.

Also shown in FIG. 2 is snap ring 42 on piston 16 and detent ring 44 on rod cup 26 which help seal material within chamber 21 when fully loaded. This sealing relationship is discussed more fully below with reference to FIG. 3.

FIG. 3 is a side cross-sectional view of the dispenser of the present invention taken along line 3-3 of FIG. 1 with a cover over the dispensing head and with the piston in a retracted position. Cover 6 is provided with outlet plug 40 which protrudes through product outlet 12 when cover 6 is placed over dispensing head 4. With cover 6 in this position, outlet plug 40 engages flap 38 to seal product outlet 12. When piston 16 is in its fully retracted position (i.e., before any material within chamber 21 is dispensed), snap ring 42 of piston 16 is engaged with detent ring 44 of cup 26. This helps prevent material from within chamber 21 from passing upwardly past piston 16. Once piston 16 is advanced, snap ring 42 passes around and out of engagement with detent ring 44.

Figure 4:
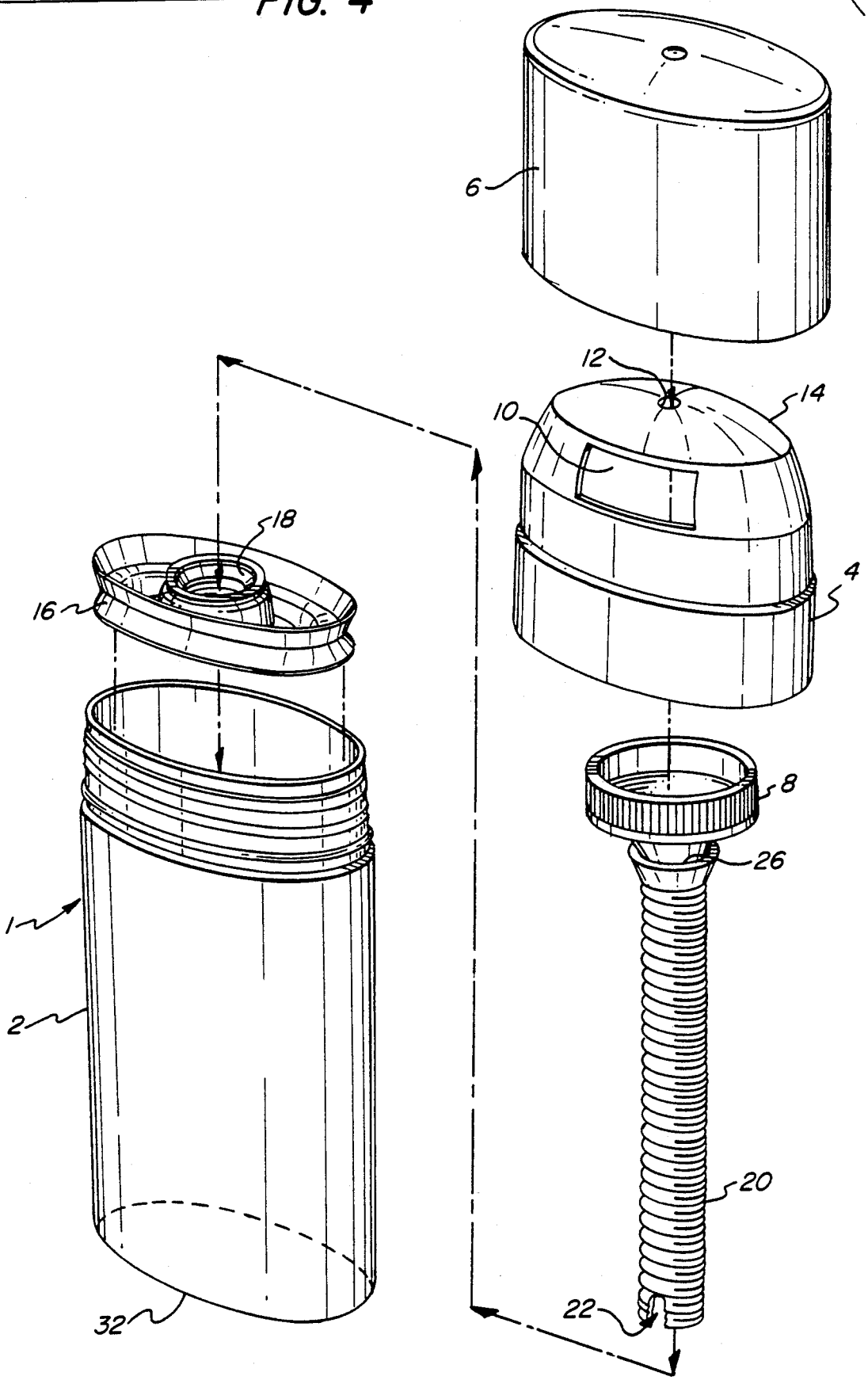
FIG. 4 is an exploded view of the dispenser of FIG. 1.

FIG. 4 shows an exploded view of the dispenser of FIG. 1, depicting all component parts individually.

In operation, piston 16 is initially at its uppermost position, as shown in FIG. 3, so that snap ring 42 sealingly engages detent ring 44. When knurled wheel 8 is rotated in the clockwise direction, piston 16 moves downwardly in the direction of arrows A. Alternatively, the direction of the threads on rod 20 can be reversed so that wheel 8 can be turned in the counterclockwise direction to move piston 16 downwardly. Using either technique, material stored within chamber 21 for dispensing is pushed downwardly toward rod opening 22. As shown by arrow B, material then passes from chamber 21 through rod opening 22 and upwardly through internal rod passage 24. Once it reaches the upper extent of internal rod passage 24, material to be dispensed passes into discharge tube 28 via rod cup 26, as shown by arrow C. Cup engagement surface 30 seals the internal sidewalls of rod cup 26 to prevent material from passing around discharge tube 28 and into the interior of dispensing head 4. Such sealing is enhanced by the downward movement of piston 16 which thrusts rod 20 and cup 26 upwardly to press cup 26 against cup engagement surface 30 of tube 28 with greater force. Material to be dispensed passes upwardly through discharge tube 28, past flap 38, through product outlet 12, and onto product application surface 14, as depicted by arrow D. Once material spreads over product application surface 14, it can be applied as desired.

The dispenser of the present invention can be easily assembled and then filled. Such filling can be accomplished either by bottom filling through the opening in bottom 32 which is sealed by plug 36 or top filling.

When bottom filling, the dispenser first must be fully assembled. First, referring to FIG. 3, the single piece unit encompassing threaded rod 20, knurled wheel 8, and rod cup 26 with piston 16 mounted in abutment with rod cup 26 is inserted into base 1 so that the open axial bottom end of threaded rod 20 seats on connection indentation 34. Dispensing head 4 is then snapped on the open end of base 1 with discharge tube 28 being inserted into rod cup 26. After, cover 6 is placed over product application surface 14, the dispenser is positioned so bottom 32 faces upwardly, and product is added to chamber 21 through the opening in bottom 32. This opening is then sealed with plug 36.

When top filling, the dispenser is first filled through the open end of base 1. The dispenser is then assembled in the same manner as discussed with respect to bottom filling. Advantageously, the dispenser components are shipped to the manufacturer of product with the unit, comprising the threaded rod 20, knurled wheel 8, and rod cup 26, having piston 16 mounted in abutment with rod cup 26, loosely placed within base 1. Dispensing head 4 and cover 6 are positioned loosely over the open end of base 1. After top filling is completed, these parts can be loosely snapped together, as discussed in the preceding paragraph.

Although the invention has been described in detail for the purpose of illustration, it is understood that such detail is solely for that purpose, and variations can be made therein by those skilled in the art without departing from the spirit and scope of the invention which is defined by the following claims.

What is claimed

1. A dispenser for flowable material comprising:

an elongate container having sidewalls extending between an open end and a closed end and defining a chamber for storing material to be dispensed;

a hollow, threaded rod having an axis extending longitudinally within the chamber, said rod having an opening adjacent the closed end of said container, and an axial opening at a bevelled end of said rod adjacent the open end of said container, said bevelled end being surrounded by a cup attached to said rod;

a piston mounted on said threaded rod by means of a threaded opening through said piston and being slidably sealingly fitted inside said container sidewalls and being axially movable in said container;

a dispensing head mounted on the open end of said container and having a product outlet for dispensing material stored in the chamber, said dispensing head having a hollow tube extending from said product outlet toward the end of said rod adjacent the open end of said container and having an open tube end located and adapted to receive and sealingly fit together with said bevelled end of said rod whereby said hollow rod and hollow tube are maintained in a joined and sealed relationship while said rod is rotated relative to said hollow tube;

a wheel coaxially mounted to and circumferentially above said cup and accessible for manual turning to rotate said hollow rod, whereby rotation of said threaded rod moves said piston along said rod toward the closed end, causing material within the chamber to pass through the opening adjacent the closed end, through said hollow rod, through the opening adjacent the open end, through the hollow tube, and out of the product outlet to the dispensing head.

2. A dispenser according to claim 1, wherein said cup and said wheel are integrally formed.

3. A dispenser according to claim 2, wherein said hollow rod and said cup are integrally formed.

4. A dispenser according to claim 1, wherein said dispensing head has at least one opening in its side walls adjacent the open end through which the wheel can be accessed and turned.

5. A dispenser according to claim 4 further comprising:

a cover mountable on said container around said dispensing head to enclose at least one opening.

6. A dispenser according to claim 1, wherein said cover is provided with an outlet plug sized and adapted to fit into and plug said hollow tube and product outlet in said dispensing head.

7. A dispenser according to claim 1 further comprising:

a snap ring formed on said piston engageable with a detent ring on the outer surface of said cup when said piston abuts said cup.

8. A dispenser for a flowable material, comprising:

an elongate container having sidewalls extending between an open end and a closed end and defining a chamber for storing material to be dispensed;

a hollow, threaded rod having an axis extending longitudinally within the chamber, said rod having an opening adjacent the closed end of said container and an axial opening at a bevelled end of said rod adjacent the open end of said container, said bevelled end being surrounded by a cup extending radially outwardly from said rod, said cup having a detent ring on a lower surface thereof;

a piston mounted on said threaded rod by a threaded opening through said piston, said piston being slidably sealingly fitted inside said container and being axially movable in said container, said piston being provided with a snap ring engageable with said detent ring on said cup when said piston abuts said cup;

a dispensing head mounted on the open end of said container and having a product outlet for dispensing material stored in the chamber, said dispensing head having a hollow tube extending from said product outlet toward the bevelled end of said rod, said hollow tube having a bevelled tube end which receives and sealingly fits together with said bevelled end of said rod whereby said hollow rod and hollow tube are maintained in a joined and sealed relationship when said rod is rotated relative to said hollow tube;

a wheel coaxially mounted to and circumferentially above said cup and accessible through openings in said dispensing head for manual turning to rotate said hollow rod, whereby rotation of said threaded rod moves said piston along said rod toward the closed end, causing material within the chamber to pass through the opening adjacent the closed end, through said hollow rod, through the opening adjacent the open end, through the hollow tube, and out of the product outlet to the dispensing head;

a cap for said dispenser, said cap having an open end for fitting over and enclosing said dispensing head and wheel and frictionally mounting on said container, said cap having an outlet plug sized and adapted to fit into and plug said hollow tube and product outlet in said dispensing head.

9. In a dispenser for a flowable material comprising a container for containing the material, a piston having a central screw threaded opening for receiving a hollow drive rod, said drive rod being operable by a wheel affixed to an upper end portion of said drive rod, said drive rod having an inlet aperture in a lower end thereof and an outlet aperture at a lower end thereof, whereby rotation of said wheel causes said piston to be driven downwardly to force said material from said container into said inlet aperture and to said outlet aperture, the improvement comprising:

a bevelled upper end of said hollow drive rod, said beveled end being surrounded by a cup extending radially outwardly from said rod and joining said wheel; and a dispensing head mounted on said container and having a hollow tube extending from the bevelled end of said hollow drive rod to a product outlet, said hollow tube having a bevelled tube end which receives and sealingly fits together with said bevelled end of said hollow drive rod whereby said hollow drive rod and hollow tube are maintained in a joined and sealed relationship when said hollow drive rod is rotated relative to said hollow tube.

10. The improvement in a dispenser according to claim 9, wherein said container and dispensing head are non-circular in cross-section.

11. The improvement in a dispenser according to claim 9, wherein said cup has a detent ring on a lower surface thereof and said piston has a snap ring engageable with said detent ring on said cup when said piston abuts said cup.

12. The improvement in a dispenser according to claim 9, further comprising a cap for said container having a plug fittable into said product outlet and hollow tube of said dispensing head.

* * * * *